US006634204B2

(12) United States Patent
Gascoin

(10) Patent No.: US 6,634,204 B2
(45) Date of Patent: Oct. 21, 2003

(54) SHEET METAL FOLLOWER FOR A BENDING PRESS

(75) Inventor: Eric Gascoin, Luynes (FR)

(73) Assignee: Amada Europe, Tremblay-en-France (FR)

( * ) Notice: Subject to any disclaimer, the term of this patent is extended or adjusted under 35 U.S.C. 154(b) by 0 days.

(21) Appl. No.: 10/046,169

(22) Filed: Jan. 16, 2002

(65) Prior Publication Data

US 2002/0092337 A1 Jul. 18, 2002

(30) Foreign Application Priority Data

Jan. 17, 2001 (FR) ..... 01 00583

(51) Int. Cl.[7] ..... B21J 13/10

(52) U.S. Cl. ..... 72/420; 72/419; 100/215; 414/589; 414/677

(58) Field of Search ..... 72/389.1–389.3, 72/417, 418, 419–421, 426, 428; 414/224.01, 225.01, 226.04, 589–677; 100/215; 11/224

(56) References Cited

U.S. PATENT DOCUMENTS 3,514,991 A * 6/1970 Merrill et al. ..... 72/420
4,341,104 A * 7/1982 Jarman ..... 72/419
4,708,573 A * 11/1987 Hug ..... 414/589
4,753,100 A * 6/1988 Hanni ..... 72/419
5,964,119 A * 10/1999 Kutschker ..... 72/306
6,079,250 A * 6/2000 Scannell et al. ..... 72/381

FOREIGN PATENT DOCUMENTS

| | | |
|---|---|---|
| DE | 4126906 | 2/1993 |
| EP | 0542610 | 5/1993 |
| JP | 64-31526 | 2/1989 |

OTHER PUBLICATIONS

Patent Abstracts of Japan, vol. 013, No. 206, published May 16, 1989.

English Language Abstract of DE 41 26 906 A1.

* cited by examiner

*Primary Examiner*—Ed Tolan
(74) *Attorney, Agent, or Firm*—Greenblum & Bernstein, P.L.C.

(57) ABSTRACT

A sheet metal follower for a bending press that has a bottom fixed table carrying a bending matrix on its top face. The follower is of the type comprising in particular pivot means for pivoting the follower table about a pivot shaft, and means suitable for moving the follower table in horizontal displacement relative to its support structure and perpendicularly to the pivot shaft, the active length of the pivot means being variable between a fixed hinge on the support structure and a moving hinge on the follower table, and the moving hinge being suitable for sliding along said table in a direction perpendicular to the pivot shaft of said table.

9 Claims, 4 Drawing Sheets

SHEET METAL FOLLOWER FOR A BENDING PRESS

FIELD OF THE INVENTION

The present invention relates to a sheet metal follower for a bending press, the press presenting a fixed bottom table carrying a bending matrix on its top face, and the follower being of the type comprising:

a follower table capable of pivoting about a horizontal pivot shaft at its front end;

a lateral transfer carriage mounted on the front wall of the fixed bottom table so as to be capable of moving horizontally along said front wall;

a vertical support wall secured to the transfer carriage and provided with vertical slideways and at least one vertical ball screw suitable for being rotated from its bottom end;

a support structure presenting a vertical front plate and two vertical side plates extending away from the bottom table of the press;

vertical guide rails secured to the front plate of the support structure and each co-operating with a corresponding slideway of the carriage support wall, and a drive mechanism for driving the front plate of the support structure vertically;

a follower table hinged to the support structure about a horizontal shaft parallel to the bending matrix; and means carried by said support structure suitable for causing said follower table to pivot about its shaft.

BACKGROUND OF THE INVENTION

A follower table of this type is known from patent JP 10 31 526. Ignoring its complicated structure due to the two support structures nested one in the other and hinged about a common horizontal pivot shaft for the follower table, that shaft is nevertheless too far away from the bending matrix to be capable of ensuring that the follower table can perform pivoting that is always centered on the bottom of the matrix.

Furthermore, the combined use of toothed wheels, of actuators, and of levers requires precision assembly which is difficult to perform in the first place and difficult to maintain in service.

OBJECTS AND SUMMARY OF THE INVENTION

An object of the present invention is to eliminate or at least attenuate the drawbacks associated with the prior art and to propose a sheet metal follower of the above-specified type which can be put into position quickly and accurately and in which the pivot axis for the follower table is very close to the bending matrix.

This object is achieved by the fact that there are provided:

at the top end of each of the vertical side plates of the support structure, a respective pair of bearings that are spaced apart from each other, having axes that are horizontal, in alignment with each other, and perpendicular to the vertical front plate of said structure;

two-depth adjustment columns each slidably received in a corresponding pair of bearings;

a transverse vertical arm rigidly interconnecting the front ends of the two adjustment columns, and secured on the top face of the support structure that is raised relative to the top ends of the side plates to support fingers whose front ends have respective bearings for the horizontal pivot shaft of the follower table which, by means of its center and rear portions, covers the support structure and the members secured thereto;

a rectilinear guide member provided in the center portion of the follower table beneath the plane top wall thereof and extending in the vertical midplane of the table perpendicularly to its pivot shaft;

a hinge fork suitable for sliding on the rectilinear guide member and carrying a horizontal axis parallel to the pivot shaft;

a ball wormscrew whose top head is hinged to the fork via a connection pin parallel to the pivot of the follower table;

a pivot cage fixed on either side on one of the vertical plates of the support structure so as to be capable of pivoting about a horizontal axis parallel to the pivot shaft of the follower table and disposed close to the top end of said structure; and a nut co-operating with the wormscrew and secured to the cage in axial displacement but being free to move in rotation relative thereto, and a motor secured to the cage and having its outlet shaft parallel to the wormscrew and rotating said nut by means of a cog belt.

In other words, the sheet metal follower thus comprises a follower table which is associated with means enabling it to perform rectilinear movements in three mutually perpendicular directions plus a pivoting movement about its front shaft parallel to the greatest extent of the bending matrix, said means comprising horizontal transfer means parallel to the front wall of the fixed bottom table of the bending press and to the greatest extent of the bending matrix, vertical displacement means carried by the transfer means and secured to a support structure of the follower table, horizontal displacement means for moving the follower table horizontally relative to its support structure and perpendicularly to the pivot shaft of said follower table, and means for pivoting said table about its pivot shaft, said pivot means being of variable length between its hinge on the support structure and its hinge on the follower table, which hinge is capable of sliding along the follower table in a direction perpendicular to the pivot shaft of said table.

By means of this design, the follower table can be put into position relative to the bending matrix quickly and accurately while avoiding elements that are complicated and expensive to manufacture.

BRIEF DESCRIPTION OF THE DRAWINGS

The present invention will be better understood on reading the following non-limiting description of an embodiment of the sheet metal follower, which description is made with reference to the accompanying drawings, in which.

MORE DETAILED DESCRIPTION

Figure 1:
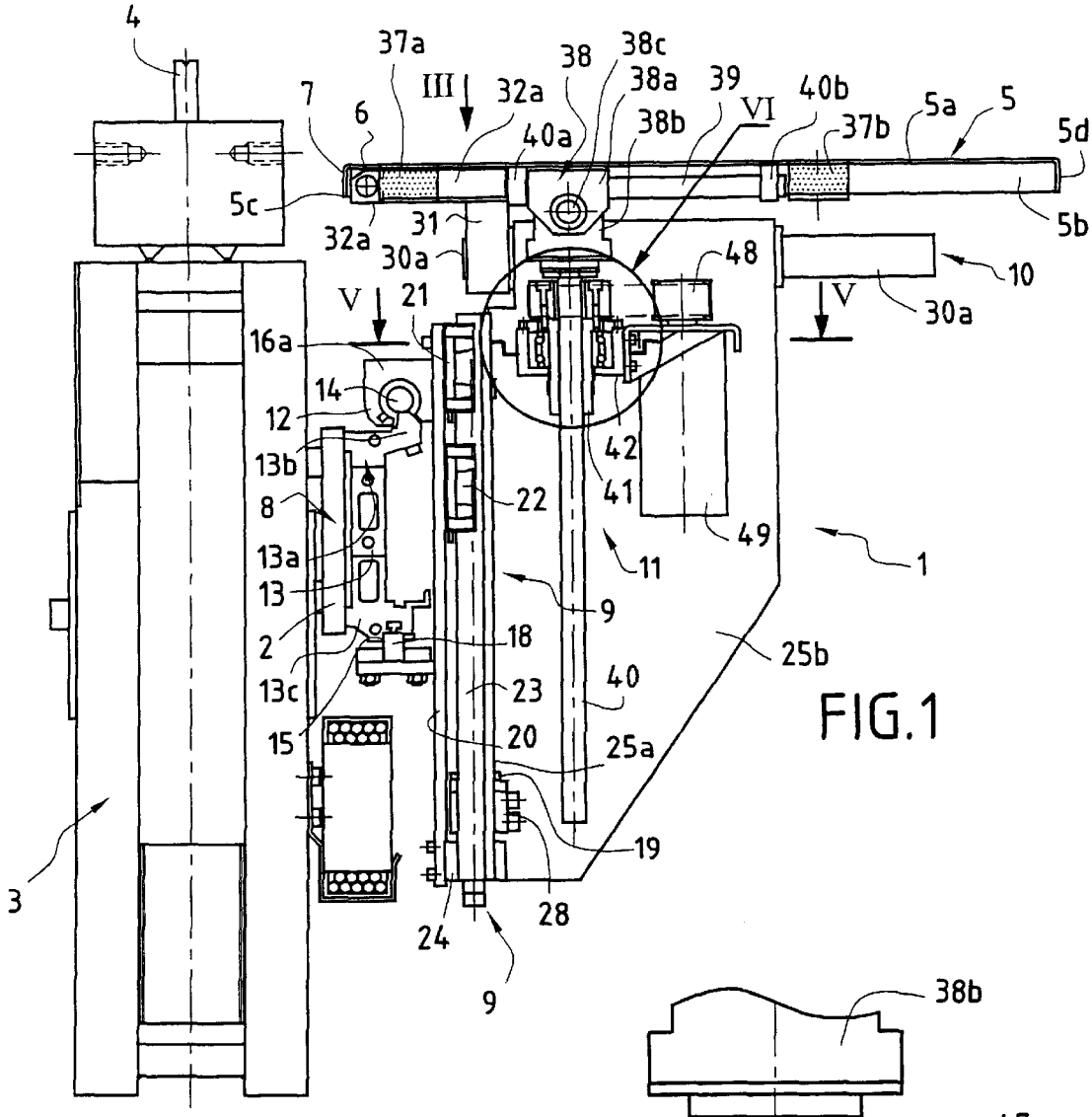
FIG. 1 is a vertical section view of the sheet metal follower on line I—I of FIG. 3, showing the follower table in the rest position and showing the fixed bottom table of a bending press.
Figure 6:
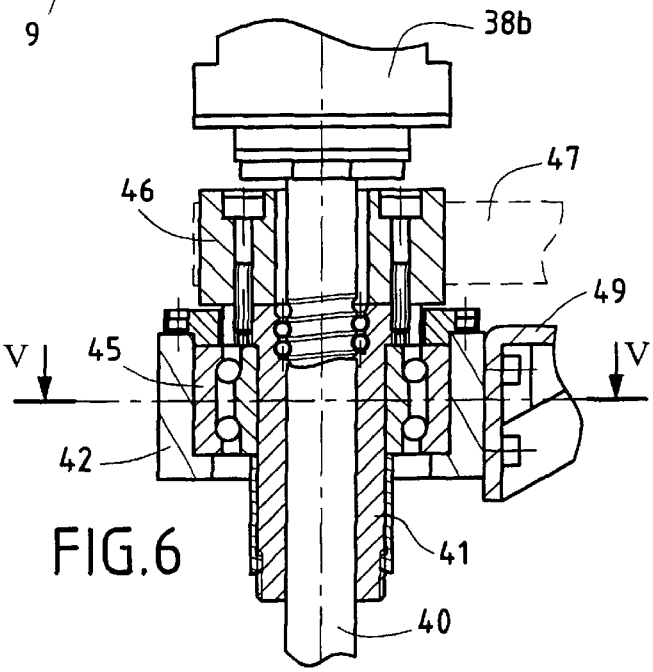
FIG. 6 is an enlarged view in elevation showing a detail defined by circle VI in FIG. 1.
Figure 2:
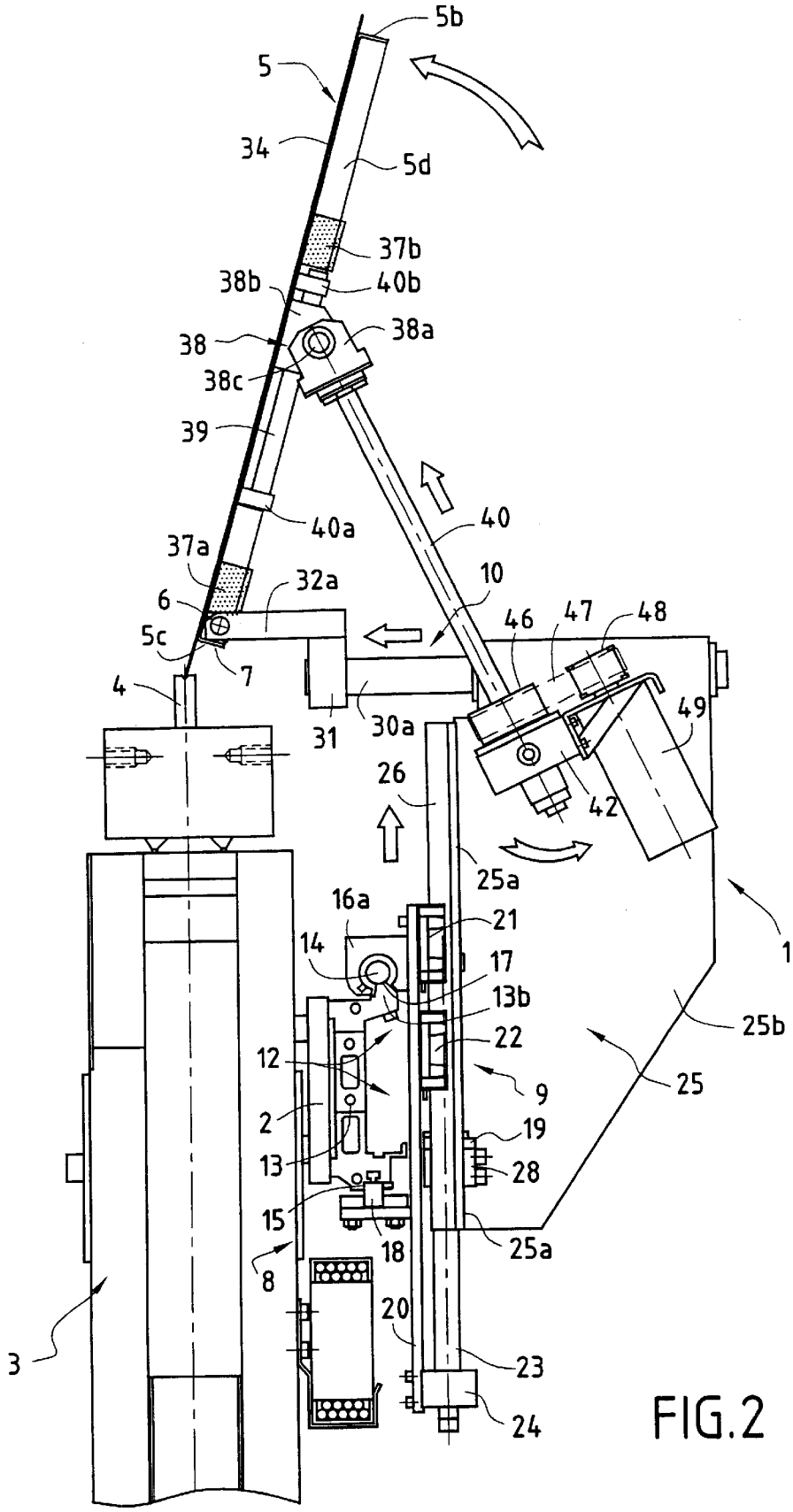
FIG. 2 is a vertical section view of the sheet metal follower on line I—I of FIG. 3, the follower table occupying a position that is steeply inclined relative to the horizontal in the vicinity of and above the bending matrix.
Figure 3:
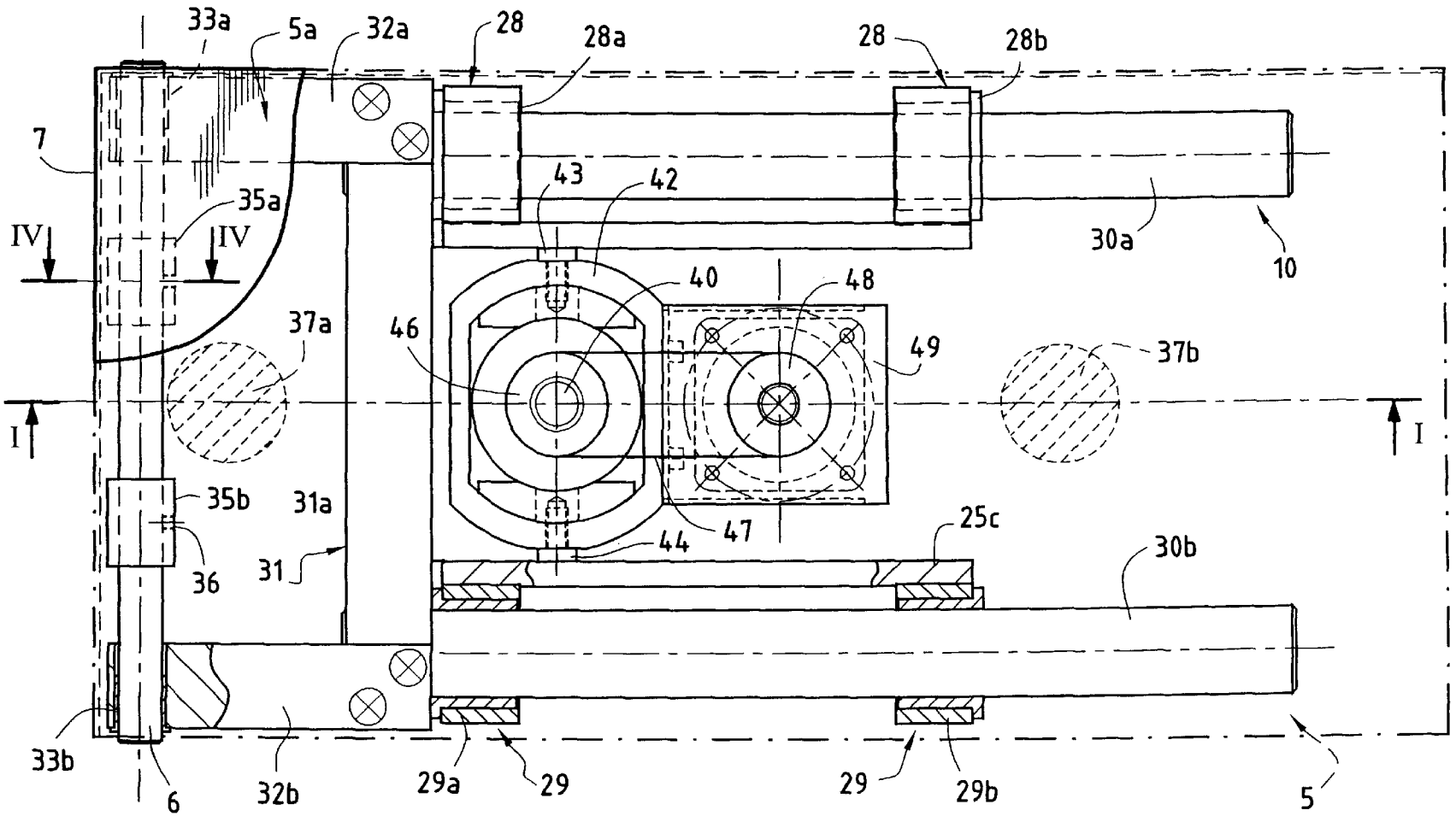
FIG. 3 is a plan view seen looking along arrow III of FIG. 1 showing a portion of the sheet metal follower, the pivoting follower table being represented by chain-dotted lines therein so as to reveal the elements mounted on the support structure.
Figure 4:
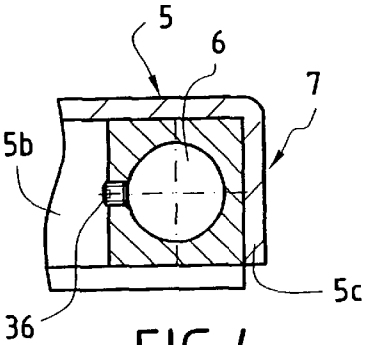
FIG. 4 is a vertical section view on line IV—IV of FIG. 3 showing how the front end of the follower table is fixed to a connection block secured to the pivot axis of said table.
Figure 5:
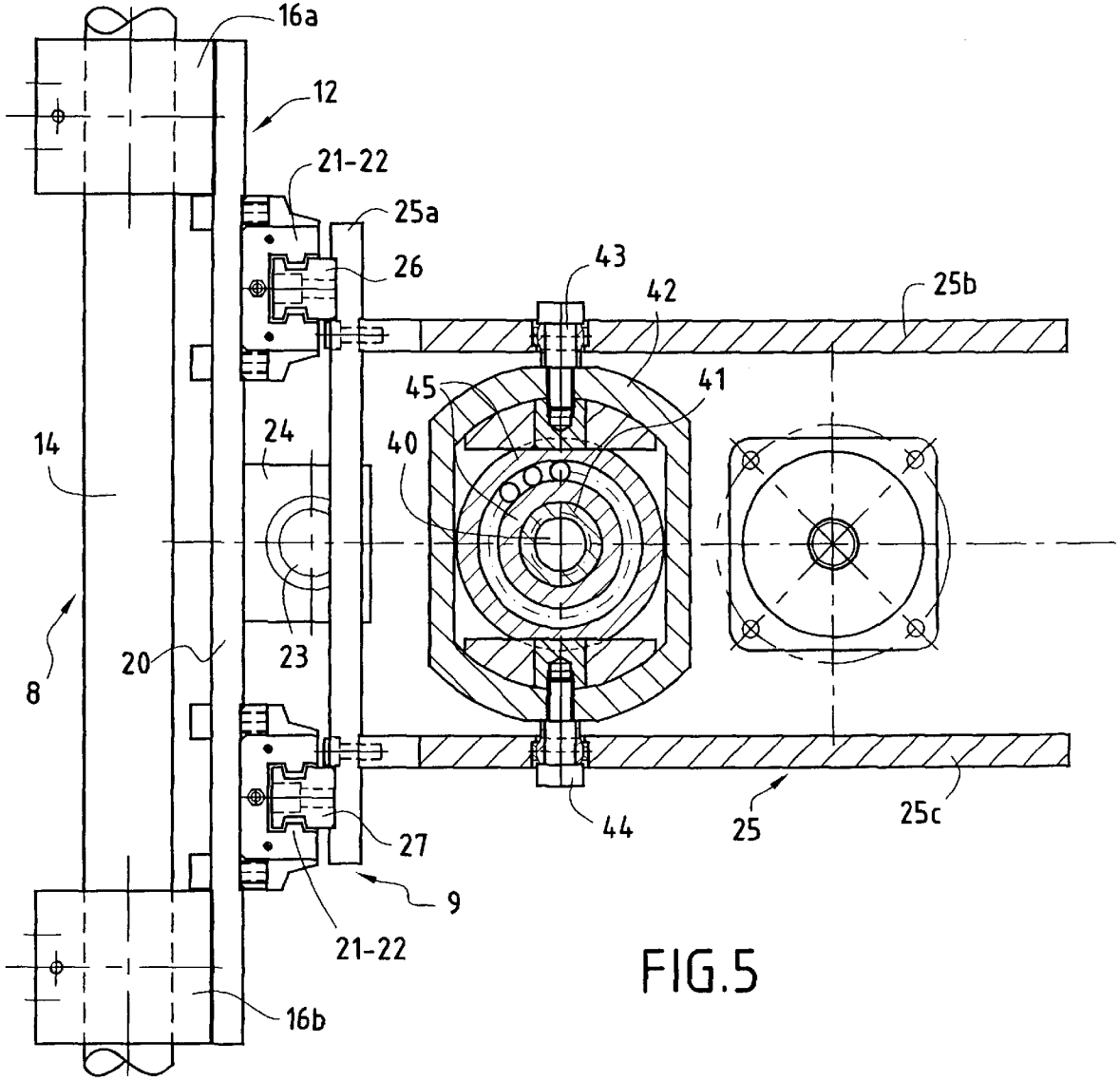
FIG. 5 is a plan view in section on section line V—V in FIGS. 1 and 6, showing the elements for horizontal transfer and vertical displacement of the support structure, together with the elements mounted thereon.

As can be seen in the accompanying drawing, and more particularly in FIGS. 1 and 2, the sheet metal follower 1 is mounted on a vertical front wall 2 of a bottom table 3 of a bending press (not shown in greater detail). At its top end, the bottom table 3 carries a bending matrix 4 whose upwardly open groove is parallel to the front wall 2.

At its top end, the sheet metal follower 1 has a follower table 5 capable of moving in rectilinear manner along axes x, y, and z and capable of pivoting about a shaft 6 which is horizontal and parallel to the vertical wall 2 and to the bending matrix 4, and which is provided at the front end 7 of the follower table 5, said front end 7 being close to said bending matrix 4.

The follower table 5 is thus associated with displacement means 8, 9, 10, and 11 which enable it to perform three mutually perpendicular rectilinear movements along the directions x, y, and z, and also to perform pivoting about the horizontal shaft 6 co-operating with the front end 7 of said follower table 5.

The first one (8) of these displacement means 8, 9, 10, and 11 comprises horizontal transfer means acting parallel to the vertical wall 2 of the bottom table 3 of the bending press and to the bending matrix 4. This first displacement means 8 comprises a transfer carriage 12 mounted on the front wall 2 in such a manner as to be capable of moving horizontally along said wall 2. This first displacement means 8 also comprises a guide 13 approximately in the form of a channel section on its side with a web 13*a* secured to the vertical front wall 2 of the table 3 and with flanges 13*b* and 13*c* respectively carrying a round guide bar 14 (on the top flange 13*b*) and a guide groove 15 (on the bottom flange 13*c* of the channel section on its side). The transfer carriage 12 has two lateral transfer bearings 16*a*, 16*b*, e.g. ball bearings, each surrounding the guide bar 14 with the exception of a rectilinear fixing zone 17 (e.g. by welding) between said bar 14 and the tip of the top flange 13*b* of the guide 13. The transfer carriage 12 also presents a guide rib 18 which engages in the groove 15 of the bottom flange 13*c* of the guide 13. The bearings 16*a* and 16*b* and the guide rib 18 are secured to a vertical support wall 20 which forms an integral portion of the lateral transfer carriage 12.

The second displacement means comprises vertical displacement means 9 with at least two vertical slideways 21, 22 secured to the vertical support wall 20 of the transfer carriage 12 and provided on the side opposite to the lateral transfer bearings 16*a*, 16*b* together with at least one vertical ball screw 23 which, for example, lies on the vertical midplane of the vertical support wall halfway between the vertical slideways 21 and 22. This vertical screw 23 is secured to the support wall 20 in axial displacement but is movable relative thereto in rotation and it co-operates at its bottom end with a rotary motor (not shown) whose casing is fixed to the bottom edge of said support wall 20.

The vertical displacement means 9 further comprises a support structure 25 presenting a vertical front plate 25*a* with its face turned towards the support wall 20 of the carriage 12 presenting two vertical guide rails 26 and 27 of T-shaped section, each engaged in a corresponding one of the vertical slideways 21 and 22 whose grooves are likewise of T-shaped section, thus enabling the said rails 26 and 27 and said front plate 25*a* to be held in a vertical position. A ball nut 19 co-operating with the vertical ball screw 23 also forms part of the displacement means 9, said nut being prevented from rotating and being secured to the bottom portion of the support structure 25, and in particular to the front plate 25*a* thereof. As can be seen more particularly on FIGS. 1 to 3 and 5, the support structure 25 also comprises two lateral vertical plates 25*b*, 25*c* parallel to each other and perpendicular to the vertical support wall 20 and to the vertical front wall 25*a* to which they are fixed rigidly. It should also be observed that the top portions of the lateral plates 25*b* and 25*c* project above the top edge of the front plate 25*a* and are set back a little relative thereto so as to leave room for an element of the third rectilinear displacement means described below.

The third rectilinear displacement means for the follower table 5 comprises displacement means 10 enabling the table to move horizontally relative to the support structure 25 and perpendicularly to the vertical plane of the front plate 25*a* thereof. The horizontal displacement means 10 comprises, on top and on the outside face of each vertical plate 25*b*, 25*c* of the support structure 25, a respective pair 28, 29 of bearings 28*a* & 28*b* and 29*a* & 29*b* having identical inside diameters that are spaced apart from each other and that have horizontal axes in alignment with each other in pairs and perpendicular to the vertical plane of the front plate 25*a* of said structure 25. For each of the two pairs of bearings 28 and 29, the means 10 also presents a depth-adjustment column 30*a*, 30*b* slidably received in a corresponding pair of bearings 28 or 29, and a transverse arm 31 rigidly interconnecting the front ends of the two adjustment columns 30*a* and 30*b*, said arm 31 being disposed above the front plate 25*a* and in front of the vertical front edges of the set back portions of the lateral plates 25*b* and 25*c*. The horizontal displacement means 10 also has two lateral support fingers 32*a* and 32*b* fixed via their rear ends to the top face 31*a* of the transverse arm 31, the top face 31*a* thereof being raised relative to the top edges of the lateral plates 25*b* and 25*c*. The front end of each support finger 32*a*, 32*b* carries a bearing 33*a*, 33*b*, each bearing receiving an end portion of the pivot shaft 6 which is secured to the front end of the follower table 5 via two fixing blocks 35*a* and 35*b* snugly receiving the pivot shaft 6 and fixed firstly to the front end of said table 5 and secondly to the shaft 6 via lock screws 36.

The follower table 5 has a plane top plate 5*a* surrounded at its periphery which is preferably rectangular in shape by side plates 5*b*, a front plate 5*c*, and a rear plate 5*d* together forming a kind of shallow skirt. Beneath the top plate 5*a*, and in particular in its longitudinal zone halfway between the side plates 5*b*, there are provided a plurality of holding magnets 37*a*, 37*b* for holding a metal sheet 34 for bending, one of the magnets (37*a*) being situated close to the hinge shaft 6 and the other magnet (37*b*) being situated in the rear portion of the follower table 5. It should be observed that in the horizontal position, the plane top plate 5*a* of the follower table 5 rests on the support fingers 32*a* and 32*b* and is prevented from tilting rearwards by the pivot axis 6 received in the bearings 33*a* and 33*b* of said support fingers 32*a* and 32*b*.

In order to cause the follower table to move horizontally forwards or rearwards, action is taken on the depth-adjustment columns 30*a* and 30*b*, either manually or else using a drive mechanism such as a rack mechanism (not shown), the rack itself optionally being incorporated in a portion of each column 30*a,* 30*b*. Once the selected horizontal position for the front edge of the follower table 5 relative to the matrix 4 has been set, said table 5 is locked in said position by preventing the columns 30*a* and 30*b* from moving relative to the support structure 25.

The pivot displacement means 11 of the follower table 5 comprises a hinge member 38 suitable for sliding along a guide rod 39 provided in the central portion and beneath the top plate 5*a* of the table 5, and provided more precisely in the vertical midplane perpendicular to said top plate 5*a* and to be pivot shaft 6, said guide rod 39 extending rearwards from the transverse arm 31 over at least one-third of the length of the table 5, and being fixed at its ends in housing blocks 40*a,* 40*b* secured to said table 5.

The hinge member 38 also comprise a hinge fork 38*a* mounted astride the guide rod 39 which constitutes a rectilinear guide member for said fork 38*a,* and also a connection piece 38*b* engaging partially into the fork 38*a* and connected thereto by a horizontal pin 38*c* so as to be capable of pivoting relative to said fork 38*a* without impeding the sliding thereof on the guide rod 39.

The pivot means 11 also comprise a ball wormscrew 40 co-operating with a ball nut 41 pivotally mounted on the top portion of the support structure 25 between the lateral plates 25*b* and 25*c* thereof so as to be capable of pivoting about a horizontal axis parallel to the pin 38*c* of the fork 38*a* and to the pivot shaft 6 of the follower table 5. The top end of the wormscrew 40 is secured to the connection piece 38*b* which thus constitutes a head of the screw. When the follower table 5 is in the horizontal position it will be observed that the wormscrew 40 occupies a vertical position and also that the pin 38*c* of the hinge member 38 and the pivot shaft of the nut 41 co-operating with the wormscrew 40 both lie in the same vertical plane. When in this position, said nut 41 surrounds the top portion of the wormscrew 40. It will thus easily be understood that the pivot means 11 is of variable active length between its fixed hinge on the support structure 25 and its moving hinge (the hinge member 38) on the follower table 5, said moving hinge being capable of sliding along the table 5 in a direction perpendicular to the pivot shaft 6 of said table 5.

The ball nut 41 is partially received in a pivot cage 42 fixed on either side to respective ones of the two lateral plates 25*b* and 25*c* of the support structure by means of two partially threaded horizontal hinge bolts 43 and 44 which are in alignment with each other and which possess respective smooth portions passing through the wall of the cage 42 and constituting the horizontal pivot axis for the ball nut 41. Since the structures of ball nuts and ball screws are well known, there is no need to describe them in detail here.

It should be observed that a portion of the cylindrical periphery of the nut 41 co-operates with a ball bearing 45 disposed in the pivot cage 42, and that the enlarged top end of the nut 41 is secured to a drive pulley 46 with the wormscrew 40 passing therethrough with lateral clearance, said drive pulley 46 being connected by a looped belt 47, e.g. a cog belt, to a pulley 48 which is secured to the shaft of a drive motor 49 whose casing is fixed to the pivot cage 42.

It should be understood that the embodiment described above is given purely by way of example and can be modified in various ways without thereby going beyond the scope of the protection as defined by the accompanying claims. Thus, for example, the fork 38*a* of the hinge member 38 need not be mounted astride the guide rod 39 (see FIG. 1), but could equally well constitute the head of the wormscrew 40, so that the connection piece 38*b* would need to be shaped to be able to slide on the rod 39 while engaging in part in the fork 38*a* (see FIG. 2).

What is claimed is:

1. A sheet metal follower for a bending press presenting a fixed bottom table carrying a bending matrix on its top face and having a vertical front wall, said follower comprising:

a horizontal pivot shaft;

a follower table configured for pivoting at its front end about said horizontal pivot shaft and having a front end;

lateral transfer means mounted on said vertical front wall of the bottom table so as to be moved horizontally along said front wall;

vertical displacement means carried by said lateral transfer means, and vertically movable relative to said lateral transfer means;

a support structure for said follower table, said vertical displacement means being secured to said support structure;

pivot means for pivoting said follower table about said pivot shaft, said pivot means having a fixed hinge on said support structure, a moving hinge on said follower table, and an active length;

horizontal displacement means for moving said follower table horizontally relative to said support structure and perpendicularly to said pivot shaft;

wherein the active length of said pivot means between said fixed hinge on the support structure and said moving hinge on the follower table is variable; and wherein said moving hinge is configured for sliding along said table in a direction perpendicular to the pivot shaft of said table.

2. A sheet metal follower according to claim 1, wherein:

said support structure has two lateral plates and a front plate, each lateral plate having an outside face and a top end; and said horizontal displacement means for moving said follower table comprises:

at said top ends and at said outside faces of each of the lateral plates of the support structure, a respective pair of bearings, said bearings in each pair being spaced apart from each other and being in alignment with each other on a respective horizontal axis perpendicular to said vertical front plate of the support structure support;

two depth-adjustment columns having front ends, each adjustment column being slidably received in a corresponding pair of bearings;

a transverse vertical arm rigidly interconnecting said front ends of the two adjustment columns; and two lateral support fingers having their rear ends fixed to the top face of the transverse arm and carrying at each front end a respective bearing receiving a corresponding end of said pivot shaft of said follower table.

3. A sheet metal follower according to claim 2, wherein the top portions of said lateral plates of the support structure project upwards above the top edge of said front plate and are set back a little relative to said edge, and wherein said transverse arm is disposed above the front face and in front of the vertical front edges of the set back portions of said lateral plates of the support structure.

4. A sheet metal follower according to claim 1, further comprising two fixing blocks said pivot shaft passing therethrough snugly, said fixing blocks being fixed firstly to said front end of the table and secondly to said pivot shaft by block screws.

5. A sheet metal follower according to claim 1, wherein said follower table covers said support structure and said members which are secured to said support structure, and wherein said follower table comprises a plane top plate surrounded around its rectangular outline by side plates, a front plate, and a rear plate, together forming a kind of shallow skirt.

6. A sheet metal follower according to claim 2, wherein said follower table comprises a plane top plate, and wherein, when in the horizontal position, said follower table rests via said plane top plate on said support fingers and is held against any rearward tilting by said pivot shaft received in said bearings of said fingers.

7. A sheet metal follower according to claim 1, further comprising a guide rod provided in the central portion beneath the top plate of the follower table, and wherein said moving hinge of said pivot means comprises firstly a hinge fork mounted astride said guide rod, and secondly a connection piece engaged partially in said fork and connected thereto by a horizontal pin for pivoting relative to said fork without impeding the sliding thereof on said guide rod.

8. A sheet metal follower according to claim 7, wherein said pivot means further comprises a wormscrew in the form of a ball screw secured at its top end to said connection piece or to said fork of said moving hinge, a ball nut co-operating with said wormscrew and mounted in a fixed position but configured for pivoting on the top portion of the support structure so as to be configured for pivoting about a horizontal pin parallel to the pin of said moving hinge, a drive motor having an outlet shaft, a first pulley carried by said outlet shaft, a looped belt, and a second pulley secured to said nut and having the wormscrew passing therethrough with clearance, said looped belt connecting said first and second pulleys.

9. A sheet metal follower according to claim 8, further comprising a pivot cage hinged on said lateral plates of said support structure by means of hinge belts, and a ball bearing; and wherein said ball nut is mounted in said pivot cage via said ball bearing, and said drive motor is fixed on said pivot cage.

* * * * *